US007794192B2

(12) United States Patent
Wright et al.

(10) Patent No.: US 7,794,192 B2
(45) Date of Patent: Sep. 14, 2010

(54) APPARATUS FOR HANDLING AND RACKING PIPES

(75) Inventors: Monte Neil Wright, Calgary (CA); William John Stroshein, Calgary (CA); David Louis Richard, Calgary (CA); Andrew Scott Banister, Calgary (CA)

(73) Assignee: Iron Derrickman Ltd., Calgary (CA)

( * ) Notice: Subject to any disclaimer, the term of this patent is extended or adjusted under 35 U.S.C. 154(b) by 131 days.

(21) Appl. No.: 11/785,446

(22) Filed: Apr. 18, 2007

(65) Prior Publication Data

US 2007/0193750 A1 Aug. 23, 2007

Related U.S. Application Data

(63) Continuation-in-part of application No. 10/997,930, filed on Nov. 29, 2004, now Pat. No. 7,331,746.

(51) Int. Cl.
*E21B 19/00* (2006.01)
*A01G 23/02* (2006.01)

(52) U.S. Cl. ..... 414/22.65; 414/23; 414/746.3

(58) Field of Classification Search ..... 166/77.51; 173/4; 175/52, 85; 294/102.2, 106, 88; 405/154.1; 414/22.63, 22.65, 22.68, 22.71, 414/23, 746.3; 81/57.16, 57.17, 57.18, 57.19, 81/57.22, 57.35; 901/1, 14–15, 21–22, 25, 901/37, 39

See application file for complete search history.

(56) References Cited

U.S. PATENT DOCUMENTS 2,295,720 A * 9/1942 Dietzmann et al. ..... 166/77.51
3,481,229 A * 12/1969 Dickmann et al. ..... 81/57
3,633,767 A * 1/1972 Mitchell et al. ..... 414/22.68
4,013,178 A * 3/1977 Brown et al. ..... 414/22.63
4,067,369 A * 1/1978 Harmon ..... 144/34.1
4,077,525 A * 3/1978 Callegari et al. ..... 414/22.63
4,113,033 A * 9/1978 Lindblad ..... 173/1
4,117,941 A * 10/1978 McCleskey et al. ..... 414/22.63
4,212,577 A * 7/1980 Swanson ..... 414/23
4,274,778 A * 6/1981 Putnam et al. ..... 414/22.71
4,345,864 A * 8/1982 Smith et al. ..... 414/22.63
4,462,733 A * 7/1984 Langowski et al. ..... 414/22.71
4,531,875 A * 7/1985 Krueger ..... 414/22.68
4,582,133 A * 4/1986 Tambs ..... 166/77.51
4,621,974 A * 11/1986 Krueger ..... 414/800
4,725,179 A 2/1988 Woolslayer et al.
4,765,401 A * 8/1988 Boyadjieff ..... 166/77.53

(Continued)

*Primary Examiner*—Gregory W Adams
(74) *Attorney, Agent, or Firm*—Antony C. Edwards

(57) ABSTRACT

An apparatus and method for handling pipes in a derrick and racking the pipes on a pipe racking assembly mounted on the derrick. The apparatus includes a rotatable gate assembly rotatably mounted on the pipe racking assembly. The rotatable gate assembly includes a collar rotatably mounted to a first end of a rotatable pipe support. A pipe manipulator arm is pivotably mounted on a second end of the rotatable gate assembly. The collar defines a gate for securing an upper portion of the pipe stand. A pipe mount is mounted to a distal end of the arm for holding the pipe stand for transport between the derrick and the gate, and between the gate and the pipe rack. After the arm secures the pipe stand into the gate from the derrick, a drive mechanism rotates the rotatable gate assembly to a rack facing position from the derrick facing position such that the arm may transport the pipe between the gate and the pipe rack.

12 Claims, 17 Drawing Sheets

U.S. PATENT DOCUMENTS 6,343,662 B2 * 2/2002 Byrt et al. ..... 173/4
6,550,128 B1 * 4/2003 Lorenz ..... 29/464
6,821,071 B2 11/2004 Woolslayer et al.
2001/0025727 A1 * 10/2001 Byrt et al. ..... 175/7
2002/0157870 A1 * 10/2002 Bischel et al. ..... 175/52

* cited by examiner

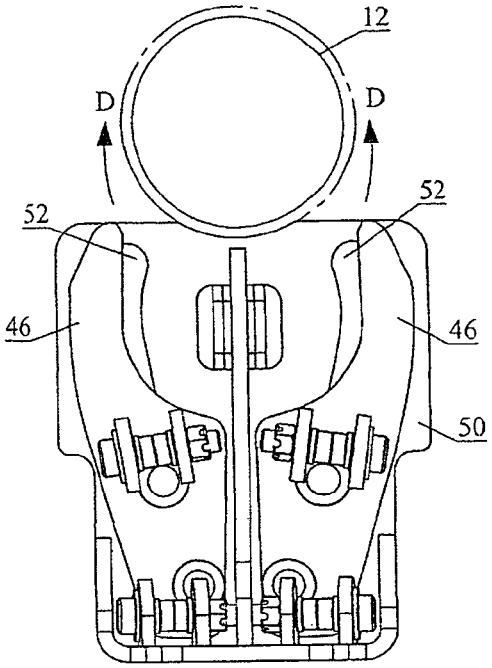
Fig 16a
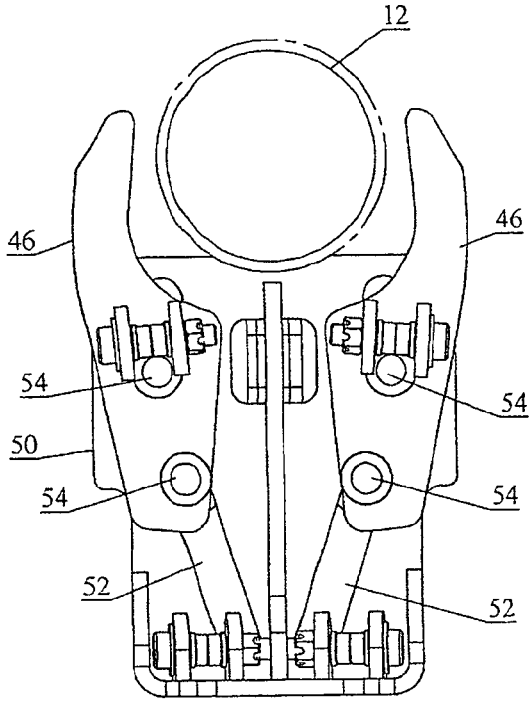
Fig 16b
Fig 16d
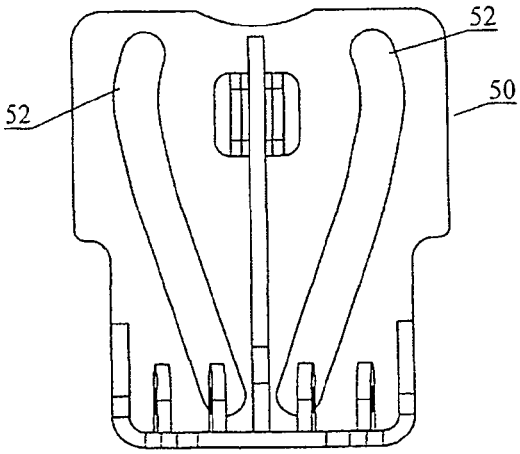
Fig 16c
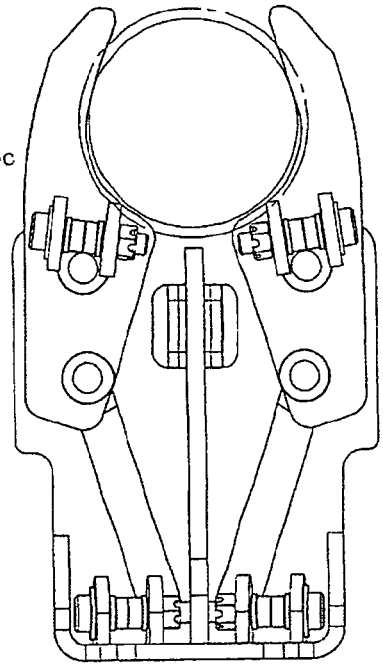

APPARATUS FOR HANDLING AND RACKING PIPES

CROSS REFERENCE TO RELATED APPLICATION

This is a Continuation-in-Part Patent Application of U.S. patent application Ser. No. 10/997,930 filed Nov. 29, 2004 now U.S. Pat. No. 7,331,746.

FIELD OF THE INVENTION

This invention relates to the field of equipment used in the drilling industry, and more particularly, it relates to an apparatus for manipulating and racking pipes in a drilling derrick.

BACKGROUND OF THE INVENTION

In drilling operations, the derrick is the structure designed to support and manipulate the drill string in and out of the well bore. The drill string is a series of drill pipe segments detachably connected together. Typically, the drill pipe segments are coupled together to form a pipe stand of a predetermined or standard length and the pipe stands are then coupled together to form the drill string.

A drill collar and a drill bit are attached to a drill end of the drill string. The drill collar is a heavier pipe having a larger diameter which fits around the drill pipe and places weight on the drill bit such that the downward force from the weight of the drill string, drill collar, and other drilling equipment on the drill bit assists in the drilling process. As the drill bit and drill string rotate and penetrate into the well bore, additional lengths of pipe stands may be connected to the coupling end of the drill string. Each pipe stand is typically thirty to forty five feet in length for larger drilling operations and between fifteen and twenty feet for smaller operations.

Because the drill bit has to be changed after a few days or even a few hours, depending on the hardness of the matter being drilled through, the drill string must be raised and lowered frequently. This involves withdrawing the drill string from the well bore by conventional hoisting means such as a winch mounted to the derrick, uncoupling the pipe stands of the drill string using a power wrench, and stacking the pipe stands in a conventional pipe storage or racking assembly such as a finger board assembly. In larger operations, the drill string can weigh several hundred tonnes and requires an extremely powerful motor housed in the derrick to withdraw the drill string from the well bore. Typically, electric or hydraulic pipe handling systems transport pipe stands between the well bore and the derrick and the storage assembly. After replacing the bit, the pipe stands are removed from the storage assembly by the pipe handling system and transported back to the drill string where the pipe stands are recoupled with the drill string and lowered back down the well bore to recommence drilling. Known as a "round trip", this operation can take up to ten hours or more, depending on the depth of the well.

There are several devices and apparatus known in the art designed to improve the efficiency of the round trip operation. For example, U.S. Pat. No. 4,621,974 to Krueger, issued Nov. 11, 1986, provides an automated pipe equipment system for automatically removing pipe stands from and adding pipe stands to a drill string by using sensing means such as transducers to indicate to a programmable controller whether a pipe joint has been grasped by a racking arm. This system increases the efficiency of the round trip operation by reducing the manual labour typically required to facilitate various steps in the operation, such as ensuring that the racking arm has securely grasped the pipe stand. Furthermore, U.S. Pat. No. 4,117,941 to McCleskey Jr. et al., issued Oct. 3, 1978, provides a device which rapidly handles and vertically racks riser pipes and drill pipes in the drilling derrick. Manipulators effect the desired displacement of the pipes such that the lower ends of the pipes may rest on a set back platform on the drill floor and the upper ends of the pipes may be secured in a finger board. In addition, U.S. Pat. No. 4,013,178 to Brown et al., issued Mar. 22, 1977, provides a pipe racker wherein a maneuverable arm mounted on the derrick may grip the pipe joint anywhere along its length, lift the pipe, and move the pipe to another location without the need of a cable support. The vertical, horizontal and telescoping of the maneuverable arm provides the racker with three orthogonal degrees of freedom.

Applicant is also aware of U.S. Pat. No. 2,295,720 to Dietzmann who teaches a wrench with a slot in one side through which a sucker rod can enter. The wrench is rotated through hearing and once the sucker rod is unscrewed it is removed through the same slot. There is no teaching nor suggestion for the sucker rod to enter on one side of the wrench structure and exit on the opposite side. In the present invention drill pipe enters from a well bore side of a rotatable gate assembly, is rotated one hundred eighty degrees and exits from the opposite side for racking in a pipe rack.

While the prior art provides devices for handling pipe stands, they do not provide the solution according to the present invention to address the conventional inefficiencies and the instability associated with manipulating and transporting pipe stands that may exceed thirty feet in length and several tonnes in weight. For example, the prior art does not mount the handling device within the pipe path but at the outer perimeters thereof, the ability to mount the machine within the pipe path minimizing weight and size. In the Krueger patent, a clamp engages only an upper portion of the pipe to effect vertical and rotational movement, leaving the mid-portion and lower portion of the pipe vulnerable to undesired swaying movement which may affect the racking rate. Furthermore, in the prior art the repeated use of clamps and other similar securing means causes scarring of the pipe stands which eventually causes weakening and breakage of the pipe stands. Conventional securing means used in the art also fails to provide proper or adequate support of the weight of the pipe stand. Therefore, an unaddressed need exists in the industry to provide an apparatus for handling pipes in a stable and efficient manner to deal with deficiencies and inadequacies in the prior art.

SUMMARY OF THE INVENTION

The apparatus according to the present invention is mounted near the center of the pipe path. The support and spanning components may thus be smaller than in the prior art due to the reduction of reach required. The apparatus stabilizes and supports a pipe stand being transported between the well bore axis in a derrick and a pipe rack such that unwanted movement of the pipe stand, which affects the rate of racking, may be reduced, and wherein the apparatus is mounted in the pipe flow or transfer path, thereby increasing racking efficiency. A rotating gate according to the present invention in combination with an articulated arm provides, in essence, a means to pass drill pipe from above the well bore to a pipe rack through a side of an oil well drilling rig or beam assembly supporting the rotating gate and spanning the opening providing access to the racking board.

In particular, in one preferred embodiment, the apparatus includes a rotatable gate assembly mounted between the pipe rack and derrick so as to be within the pipe transfer path. The rotatable gate assembly includes a substantially U-shaped collar having an associated drive and an arm. The collar defines a gate opening to receive and secure an upper portion of a pipe stand. The collar is rotatably mounted relative to a support frame. The first end of the arm is pivotably and rotatably mounted below the collar, for example to a lower end of a shaft or tube on which the collar is mounted. A releasable pipe mount is mounted to the second end of the arm, opposite the first end, to engage a predetermined portion of the pipe stand. The releasable pipe mount may include an upper securing means which engages for example an upper or mid-portion of the pipe stand and a lower securing means such that the lower securing means may securely engage a lower portion of the pipe stand. The upper and lower securing means may be mounted on a pipe mount carriage, which may be an arm, elongate frame, etc., to provide support for, and stability to the pipe stand, while it is transferred along its transfer path between the derrick and the rack.

The upper securing means may be a pair of independently actuable retractable jaws extendable to engage the pipe stand to prevent movement of the pipe stand relative to the pipe mount. The lower securing means may be a support member, for example a collar, attached to a lower end of a carriage on which the jaws are mounted such that the support member may receive the pipe stand to support the weight of the pipe stand and prevent movement of the lower portion of the pipe stand relative to the pipe mount. In such an embodiment the lower securing means may be the primary support for the pipe stand. The support member may be configured to engage and mate with a tool joint on the pipe stand.

The apparatus further comprises a first actuator configured to tilt the carriage and the upper and lower securing means mounted thereon such that the pipe stand once securely engaged by the upper and lower securing means may be raised, for example along the well bore axis, by a second actuator on the carriage and maintained vertical by the first actuator for transport between the well bore axis in the derrick and the pipe rack by translation of the pipe stand through the side of the derrick. In one embodiment, when engaging the lower securing means with the pipe stand, the second actuator raises the carriage to slide the lower securing means upwards to engage the tool joint on the pipe stand.

The arm is pivoted relative to the collar by a third actuator which may be mounted between the first end of the arm and the shaft or tube such that the arm may displace between a vertical position immediately below the collar and substantially parallel to the pipe stand and an angled position wherein the carriage is translated away from the collar and is brought adjacent to the pipe stand, for example in either the well bore axis in the derrick or in the pipe rack. The arm displaces between the vertical position and into the angled position so that the carriage on the end of the arm may securely engage the upper and lower securing means to the pipe stand in the derrick. The arm may then be retracted, that is, returned to the vertical to bring the pipe stand to mate in the gate collar. In use, the collar is then rotated one hundred eighty degrees in a horizontal plane so as to rotationally carry the pipe stand one hundred eighty degrees with it. The arm may then displace between the vertical position and the angled position such that the arm may transfer the pipe stand securely engaged to the upper and lower securing means to and from the pipe rack.

A drive mechanism rotates the rotatable gate assembly between a pipe engaging position, wherein the rotatable gate assembly is in operable communication with the derrick, and a pipe racking position, wherein the rotatable gate assembly is in operable communication with the pipe rack. The pipe rack comprises a frame and a plurality of support members such as so-called fingers, Wherein each of the support members are attached to the frame at a first end only such that a central gap or slot is defined between the support members. The support members capture and retain a pipe stand when the arm racks the pipe stand into a slot between the support members.

BRIEF DESCRIPTION OF THE DRAWINGS

These and other features of the invention will become more apparent from the following description in which reference is made to the appended drawings wherein:

FIG. 16*a* is, in partially cut away view, the view of FIG. 15 with both jaws of the pipe gripper retracted.

FIG. 16*b* is the view of FIG. 16*a* with both jaws of the pipe gripper partially extended.

FIG. 16*c* is the view of FIG. 16*b* with the jaws of the pipe gripper fully extended.

FIG. 16*d* is a partially cut away view of FIG. 16*a* cut away so as to show the cam plate.

DETAILED DESCRIPTION OF EMBODIMENTS OF THE INVENTION

Figure 1:
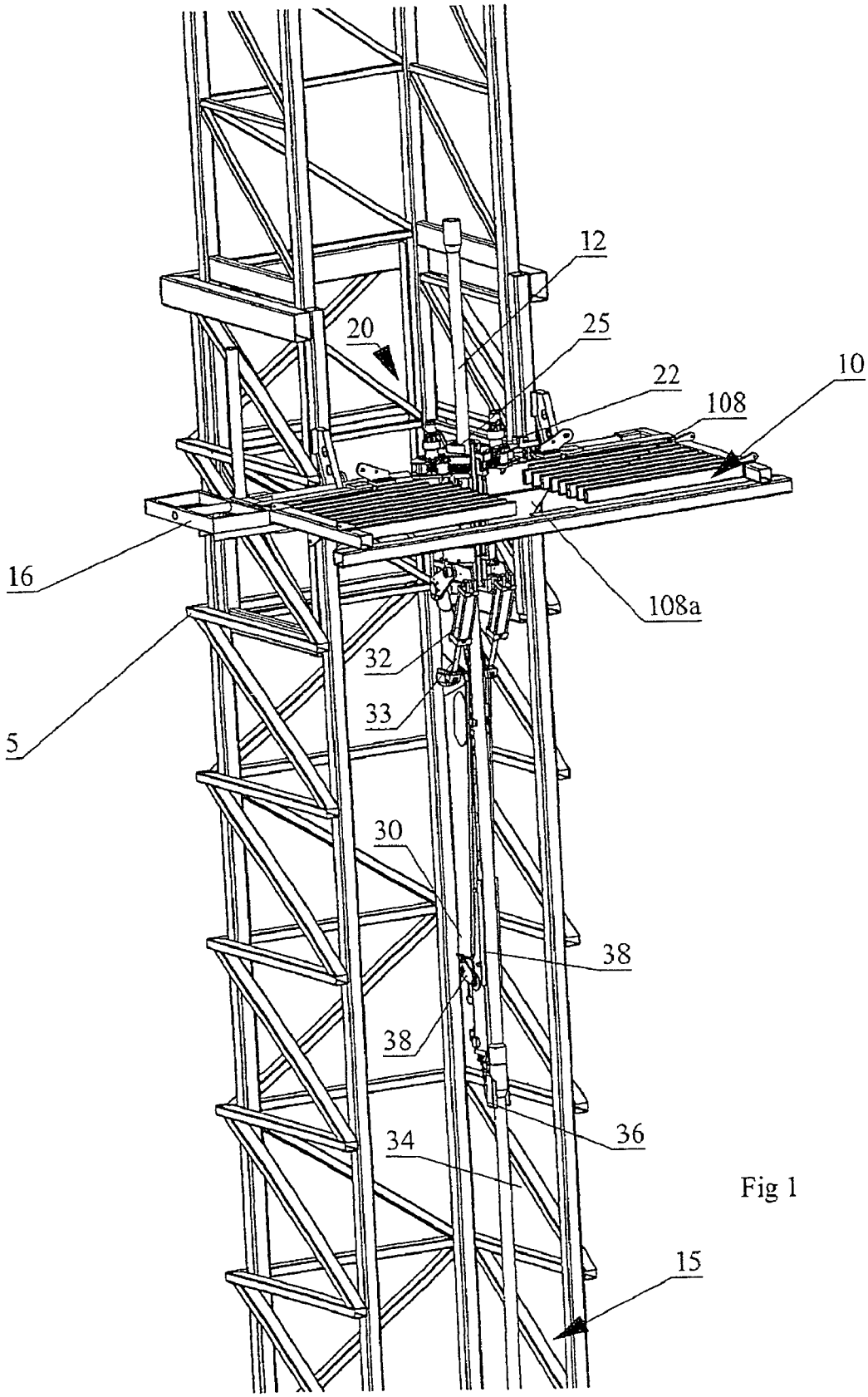
FIG. 1 is a side perspective view of the apparatus for handling pipes according to one embodiment of the present invention.
Figure 2:
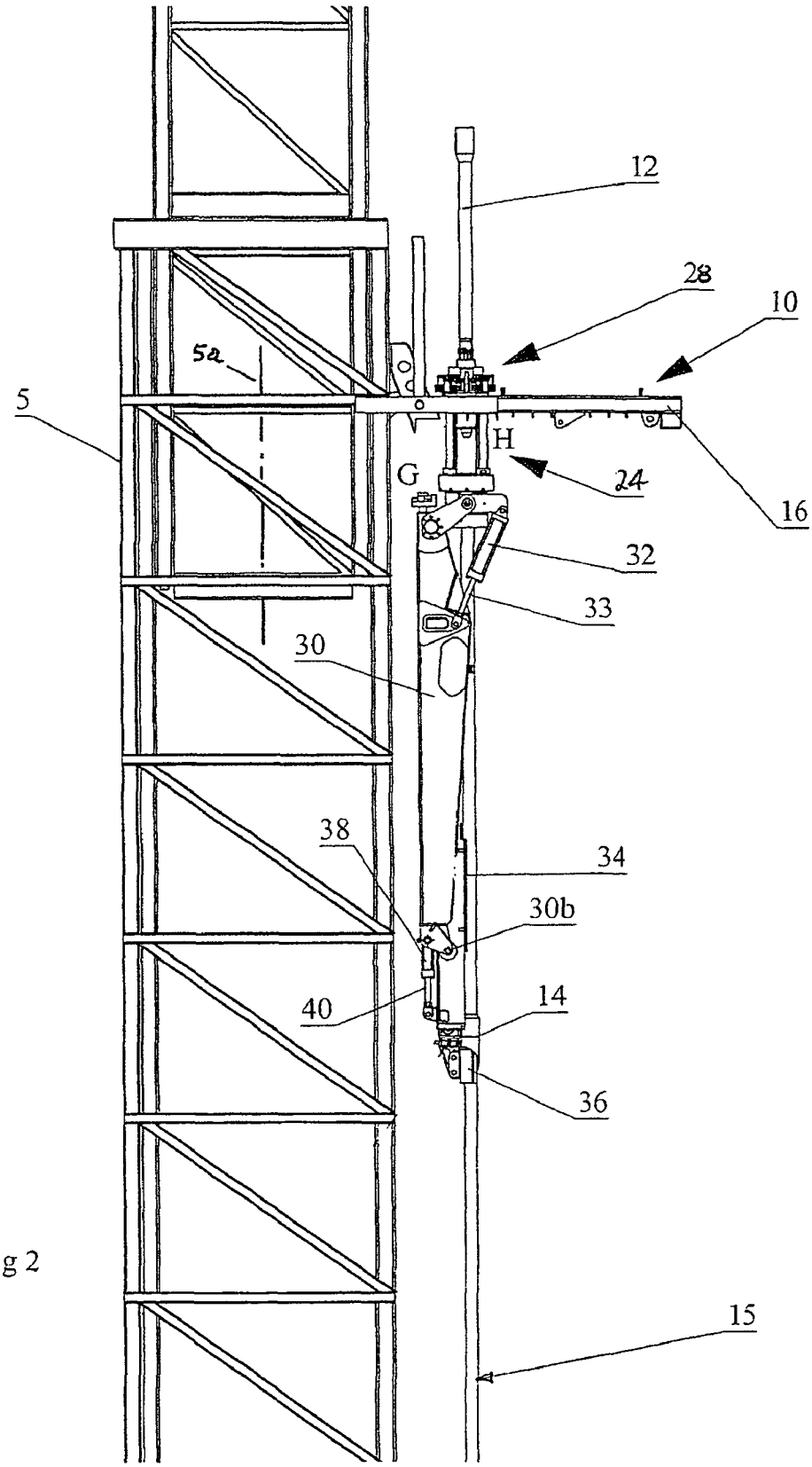
FIG. 2 is a side view of the apparatus of FIG. 1.
Figure 2A:
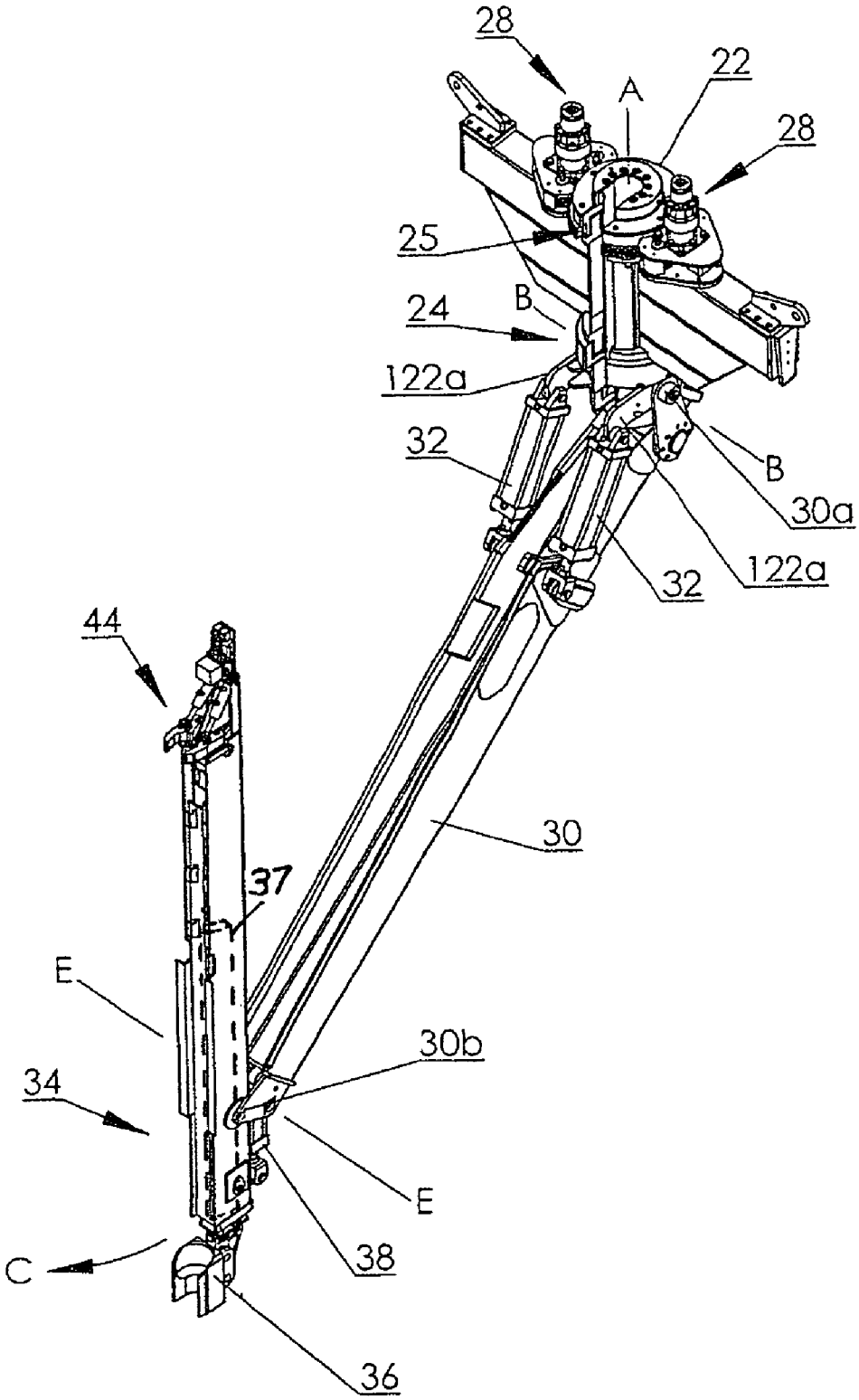
FIG. 2*a* is a side perspective view of the pipe racking assembly and the rotatable gate assembly of the apparatus for handling pipes as shown in FIG. 1.
Figure 2B:
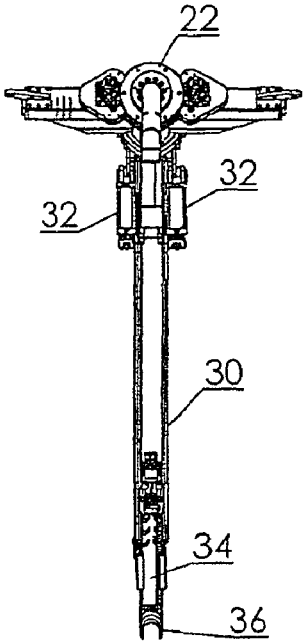
FIG. 2*b* is a plan view of FIG. 2*a*.
Figure 2C:
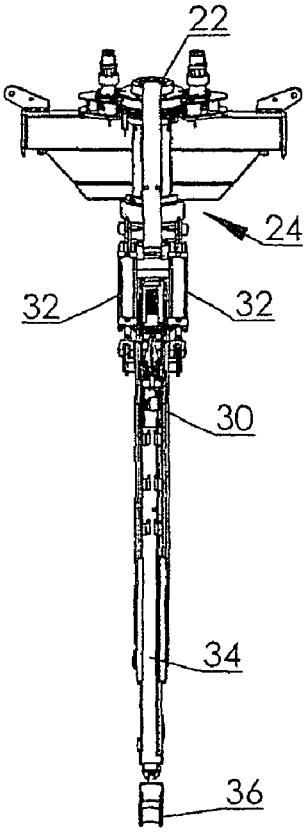
FIG. 2*c* is a front view of FIG. 2*a*.
Figure 2D:
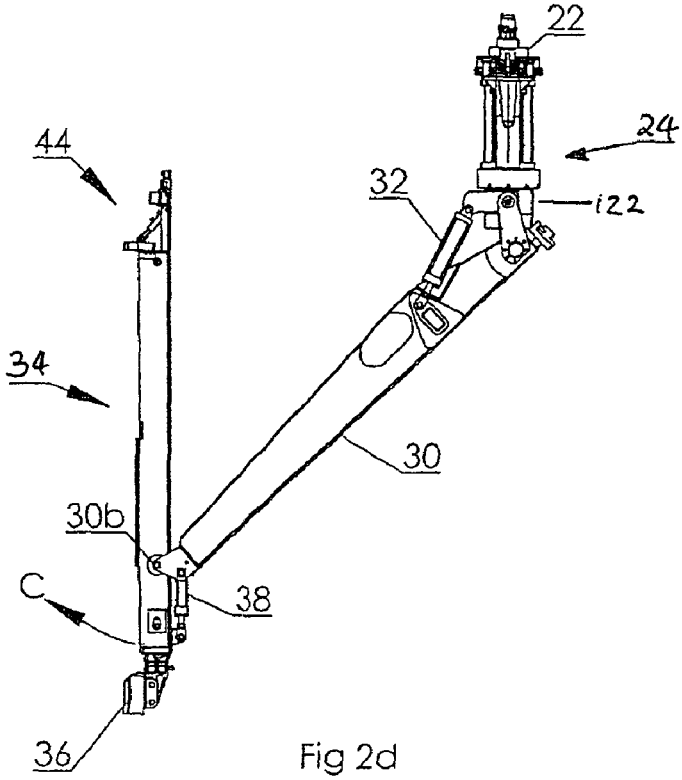
FIG. 2*d* is a side view of FIG. 2*a*.
Figure 3:
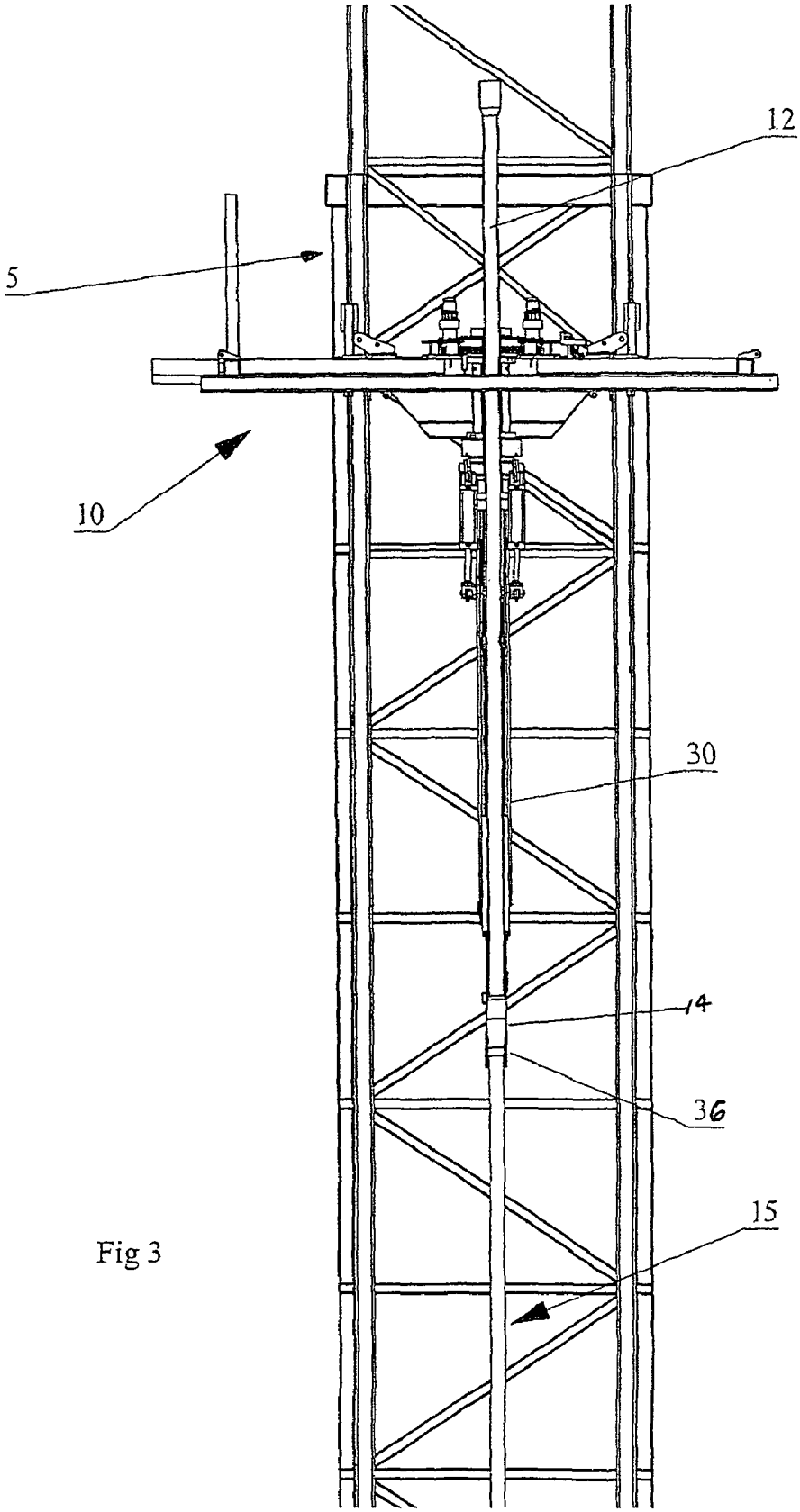
FIG. 3 is a front view of the apparatus for handling pipes as shown in FIG. 1.

With reference to the Figures wherein similar characters of reference denote corresponding parts in each view, the apparatus for handling pipes according to the present invention is mounted on a derrick 5 having a well bore axis or well center 5*a*. The apparatus includes a pipe racking assembly 10 and a rotatable gate assembly 20 mounted thereto. In an embodiment of the present invention, the apparatus for handling pipes is configured to handle and rack a plurality of pipe stands 12 which are detachably coupled together to form a drill string 15. Pipe stands 12 are formed by coupling a plurality of pipe joints together. The ends of each pipe joint are flared such that at the point of coupling between pipe joints and pipe stands 12, an annular flange known in the art as a tool joint 14 is formed.

In an embodiment of the invention, pipe racking assembly 10 includes a generally planar and rectangular frame which is horizontally disposed when mounted on derrick 5. Pipe racking assembly 10 is mounted to a mid-portion of derrick 5 such that pipe racking assembly 10 extends cantilevered outwards and away from derrick 5. In particular pipe racking assembly 10 includes a frame 16 and a plurality of transversely disposed so-called fingers or elongate support members 18 coupled to frame 16 such that each support member 18 attaches to frame 16 at a first end only, thereby defining a central gap 17 between the distal ends 18*a* of support members 18. Rotatable gate assembly 20 is mounted to frame 16 such that rotatable gate assembly is positioned in gap 17 so that a pipe stand 12 may travel along gap 17 between the distal ends of support members 18. To rack a pipe stand 12, pipe stand 12 is positioned in between support members 18 such that the weight of pipe stand 12 rests against one of the support members 18 and the base of the pipe stand rests on the ground or other base support at the base of the derrick.

Rotatable gate assembly 20 includes a collar assembly 22 rotatably mounted on a first end of a rotation assembly 24 such that rotation assembly 24 is journalled centrally through collar assembly 22. Preferably, collar assembly 22 is substantially U-shaped when viewed in plan view and defines a recess or a gate opening 25 for receiving and engaging a pipe stand 12. Gate opening 25 may provide additional stability to pipe stand 12, especially to an upper portion of pipe stand 12 when pipe stand 12 is received within gate opening 25. Collar assembly 22 may be rotated on rotation assembly 24 about axis A by way of a drive mechanism 28 better described below. The rotation of collar assembly 22 from a pipe stand engaging position and well bore axis 5*a* wherein opening 25 in rotatable gate assembly 20 faces derrick 5, to a pipe stand racking position wherein opening 25 in rotatable gate assembly 20 faces support members 18 of pipe racking assembly 10, enables the transport of a pipe stand 12 away from and well bore axis 5*a* in derrick 5, and through the side of the derrick for racking of pipe stand 12 in between support members 18 of pipe racking assembly 10.

Rotatable gate assembly 20 further includes an arm 30 having a first end and an opposite second end. In the illustrated embodiment arm 30 is of fixed length. However, in other embodiments, depending on the drilling operation, arm 30 may be selectively extendable in length for example telescopically. The first end of arm 30 is pivotably mounted on rotation assembly 24 by way of pivot pins 30*a* for rotation about axis B. Arm 30 is mounted on rotation assembly 24 such that drive mechanism 28 rotates arm 30 between a pipe engaging position facing and well bore axis 5*a* in derrick 5 and a pipe racking position facing gap 17 between support members 18. In the pipe engaging position, arm 30 is rotated in a vertical plane by retraction of actuators 32 so as to engage pipe stand 12 in derrick 5 with carriage 34 on the distal end of arm 30. The pipe stand is held in carriage 34 while arm 30 is retracted so as to engage the pipe stand into collar assembly 22 and while subsequently the pipe stand, arm 30 and collar assembly are rotated into the pipe racking position to hence transfer pipe stand 12 to pipe racking assembly 10 to position pipe stand 12 in between support members 18.

In the pipe engaging position, arm 30 is translated by actuators 32 to move arm 30 in direction C towards pipe stand 12 in derrick 5. Actuators 32 may be pneumatically or hydraulically operated cylinders. In an embodiment of the invention, each actuator 32 is mounted at an upper end thereof to a corresponding arm 122*a* of a horseshoe-shaped mounting bracket 122 mounted on rotation assembly 24 at a first end and operably coupled to arm 30 at a second end such that extension of rod 33 from actuator 32 causes arm 30 to displace from a vertical position parallel to pipe stand 12 to an angled position to engage carriage 34 with pipe stand 12 when in the pipe engaging position. When rotated in the pipe racking position, extension of rod 33 causes arm 30 to displace from a vertical position parallel to pipe stand 12 to an angled position to position pipe stand 12 in between support members 18. Retraction of rod 33 causes extendable arm to displace from the angled position back to the vertical position.

A securing means such as for example carriage 34 is mounted to the second end of arm 30 such that carriage 34 assists in arm 30 translating a pipe stand 12. Advantageously, carriage 34 is elongate and pivotally mounted to arm 30 so that, once translated and pivoted to engage a pipe stand 12, the carriage extends vertically along the length of pipe stand 12. Carriage 34 may extend in length between one quarter to one third the length of pipe stand 12 and engages onto pipe stand 12 without causing damage or substantial scarring to pipe stand 12 for example by the use of pipe gripper 44. Carriage 34 may engage a mid-portion of pipe stand 12 such that carriage 34 may provide greater stability and prevent pipe stand 12 from swaying when pipe stand 12 is uncoupled from drill string 15. The pipe gripper 44 is primarily used to stabilize the pipe stand once the elevator collar 36 has engaged the drill pipe by tool joint 14 and lifted the pipe stand prior to arm movement. Pipe gripper 44 may be used as a secondary pipe handling device complementing the action of the elevator collar.

Elevator collar 36 serves as a further securing means. It receives pipe stand 12 within its arms and frictionally engages therein a tool joint 14. Elevator collar 36 thus supports the weight of pipe stand 12. The recess between the arms of elevator collar 36 is sized such that when tool joint 14 slides into the recess, tool joint 14 is securely engaged and the weight of pipe stand 12 supported. Preferably, elevator collar 36 is mounted to a lower end of carriage 34 such that elevator collar 36 may provide additional stability to a lower portion of pipe stand 12.

Figure 15:
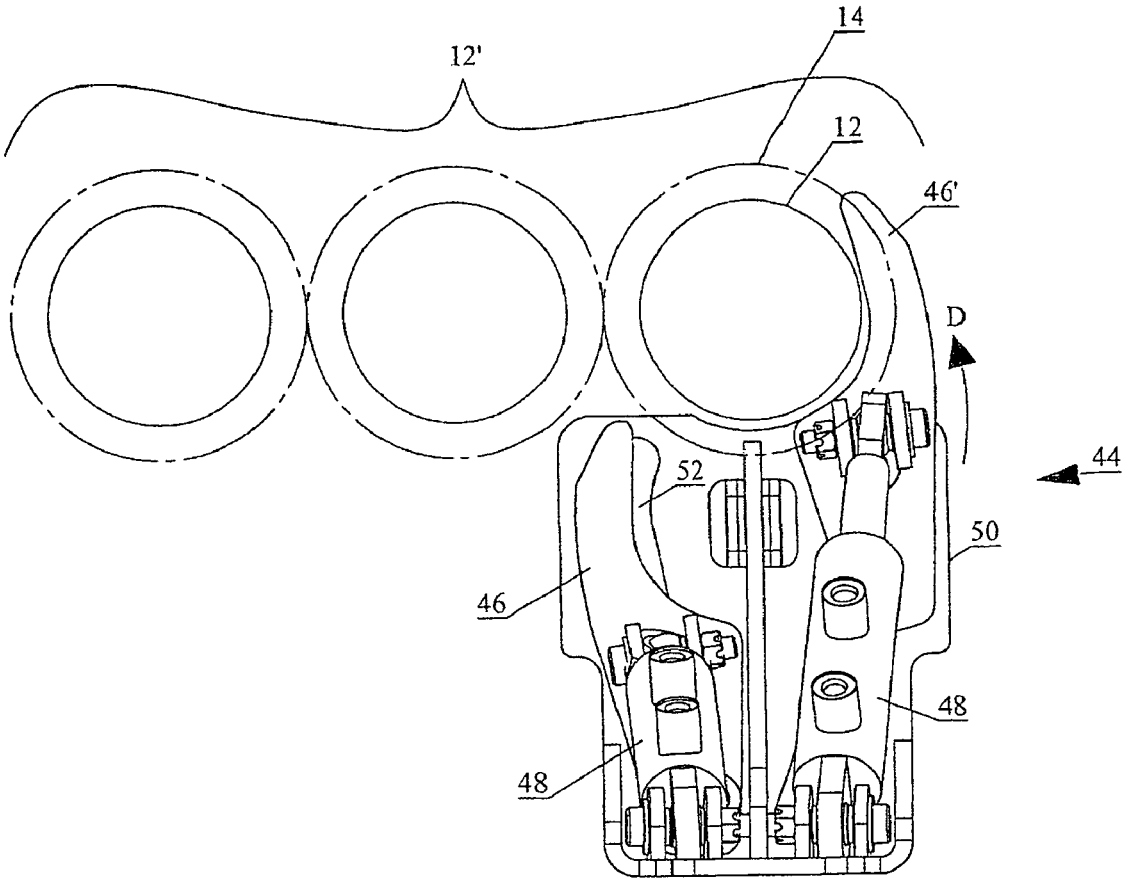
FIG. 15 is an enlarged view of a portion of FIG. 13 illustrating one of the jaws of the pipe gripper retracted.
Figure 17:
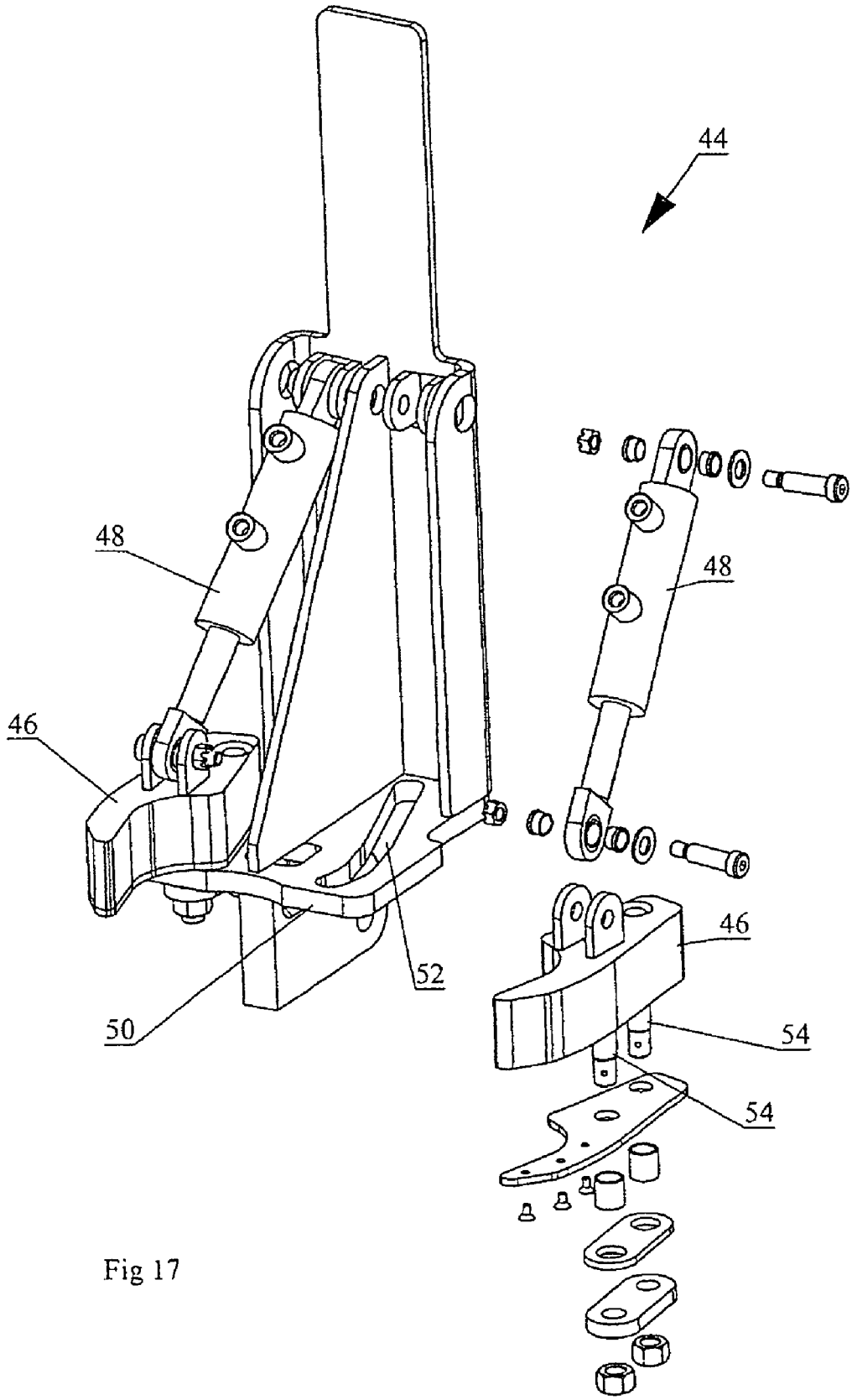
FIG. 17 is a partially exploded perspective view of the pipe gripper assembly of FIG. 14.

Pipe gripper 44 includes a pair of selectively actuable jaws 46. The gripper jaws 46 are independently controlled by a corresponding pair of actuators 48 to serve three functions. Firstly, jaws 46 work simultaneously as a pair to clamp and retain therebetween a pipe stand as shown sequentially in FIGS. 16*a*-16*c*. Secondly, as seen in FIG. 15, with jaw 46' of jaws 46 extended in direction D that is on the side of gripper 44 furthest from the pipe stack 12' jaw 46' acts as a barrier preventing the pipes in the stack from falling towards the center of the racking board, that is, into gap 17. The third function is for pipe manipulation. The operator may extend the applicable gripper jaw 46 and use it as a finger to move pipe in the desired direction, for example so as to lean the pipe over against the pipe stack 12' once the pipe is vertically lowered on the working floor.

Pipe gripper 44 has a compact profile in particular in plan view so that, when jaws 46 are retracted pipe gripper 44 fits within an envelope defined in plan view so as to not protrude beyond cam plate 40 and the other components above or below it. Thus, the pipe gripper does not interfere with the primary handling of a pipe stand gripped in the elevator collar. This facilitates handling pipes in close proximity to each other.

Jaws 46 are guided when extended in direction D by cam tracks or slots 52 formed in cam plate 50. Actuation of actuators 48 drive or retract the corresponding cam followers 54, mounted to the bottom of jaws 46, along cam tracks 52. Cam tracks 52 are shaped to diverge jaws 46 apart from each other upon initial extension of the jaws from the cam plate. This opens the distance between the jaws so that the pair of jaws may be positioned with the jaws on opposite sides of the pipe. The cam tracks then converge so that as the jaws are extended further from the cam plate, the jaws close towards each other to thereby clamp the pipe between the pair of jaws. When retracted the jaws are completely clear of the pipe. Thus at mid travel the jaws move ahead towards the pipe and open with sufficient clearance to the pipe to allow the pipe to be easily guided into position between the jaws. Near the end of the gripper jaw extension the jaws move sharply inwards towards the pipe so as to capture the pipe as required.

When lateral force is applied to the gripper via the pipe, reaction forces to the actuating hydraulic cylinders are minimal. This is due to the geometry of the guiding pins and cam slots that are nearly perpendicular to the pipe induced forces. This advantage allows positive holding and small actuators for a compact design.

After carriage 34 engages pipe stand 12, and in particular elevator collar 36 mates under a tool joint 14 on a corresponding pipe stand 12, an actuator 38 rotates carriage 34 as arm 30 retracts pipe stand 12 from derrick 5 and vertically lifts the pipe stand away from the drill string. Actuator 38 may be a pneumatically or a hydraulically operated. In an embodiment of the invention, a first end of actuator 38 is mounted to the second end of arm 30 and an opposite second end of actuator 38 is operably mounted to carriage 34 such that extension of rod 40 causes carriage 34, elevator collar 36 and pipe stand 12 to rotate about axis E on pin 30*b*.

In operation, after a pipe elevator or any other similar hoisting system raises drill string 15 to a predetermined height, actuators 32 cause arm 30 to pivot about axis B on the lower end of rotation assembly 24 and extend in direction C towards drill string 15. As arm 30 extends from the vertical position to the angled position towards drill string 15, pipe stand 12 is uncoupled from drill string 15 by conventional detaching means, such as a spinning wrench or power torque wrench. As arm 30 moves towards pipe stand 12, carriage 34 and in particular jaws 46 engage a mid-portion of pipe stand 12 to stabilize pipe stand 12 and prevent pipe stand 12 from swaying. Elevator collar 36 engages tool joint 14 of a lower portion of pipe stand 12 to support the weight of pipe stand 12 and provide stability to the lower portion of pipe stand 12. After carriage 34 is so engaged, an actuator 37 (shown in dotted outline) in carriage 34 elevates carriage 34 such that pipe stand 12 previously coupled to drill string 15 is elevated so that it may be transported away from drill string 15 and derrick 5.

To rack pipe stand 12 on pipe racking assembly 10, rotatable gate assembly 20 must rotate away from derrick 5 along with pipe stand 12 such that arm 30 may transfer pipe stand 12 to engage support members 18. To that end, the actuator 37 within carriage 34 raises elevator collar 36 so as to raise the pipe stand, following which actuator 32 causes arm 30 to retract from the angled position to the vertical position while actuator 38 maintains carriage 34 vertical such that the upper portion of pipe stand 12 is maintained vertical and thus received into gate opening 25. Drive mechanism 28 better described below then rotates collar 22 and arm 30 from the pipe engaging position facing derrick 5 to a pipe racking position towards pipe racking assembly 10 such that pipe stand 12 may be positioned in between support members 18. Actuator 32 then causes arm 30 and pipe stand 12 to extend and travel along gap 17. Pipe stand 12 is then manipulated so as to be secured in a predetermined location between support members 18. Actuator 38 manipulates carriage 34, so as to release elevator collar 36 from pipe stand 12 and jaws 46 are retracted from pipe stand 12 such that pipe stand 12 may lean against support members 18 and any other adjacent pipe stands. In particular, once the pipe has been picked up at well center and moved to the desired drop off point the pipe is handled as follows: The gripper jaw closest to the pipe stack is retracted and the furthest gripper jaw from the stack is left extended to guard against the pipe falling to the center of the racking board. The elevator collar 36 is lowered far enough to set the pipe on the working floor but not to disengage it from the pipe tool joint. The arm is then traversed to lean the pipe against the adjacent stack. The elevator collar is then lowered further to disengage the tool joint and the arm is retracted away from the pipe.

In the reverse procedure the pipe is picked up at the racking board finger slot as follows: Standard oilfield practice is to stack pipe leaning at an angle towards the outside of the racking board to ensure it maintains its position. The gripper jaw 46' furthest away from the pipe stack is first extended. This will prevent the pipe from inadvertently falling away from the pipe stack when it is being handled. The gripper jaw 46 closest to the pipe is left retracted so that it will not interfere with the pipe as the elevator collar 36 engages the pipe tool joint 14. If the close gripper is in the extended position it will interfere with the pipe primarily due to the lean of the pipe. The elevator collar 36 is then positioned and lifted to capture the tool joint. The pipe is then raised by the elevator collar. The main arm 30 and carriage 34 is then traversed down the racking board finger slot and the other gripper jaw 46 is extended to capture the pipe. The pipe is now contained between both gripper jaws 46 and is secured for movement to the center gap 17 of the racking board and on to well center.

The rotating gate assembly 20 and its related drive is mounted in the pipe path. The rotating gate collar 22 is unshaped in plan view so that a pipe stand 12 manipulated by carriage 34 and arm 30, may be slotted into the opening 25 of the rotating gate collar 22 and snugly held nested therein while the rotating gate assembly is rotated one hundred eighty degrees about axis A. Once so rotated, the carriage 34 and arm 30 are once again actuated, this time to remove the pipe stand from the rotating collar gate so that the pipe stand may then be positioned as desired, either into the finger supports 18 of the pipe rack or into the derrick 5 depending on whether the pipe stand was, respectively, coming from, or returning to, operation in the drill string 15.

Figure 4:
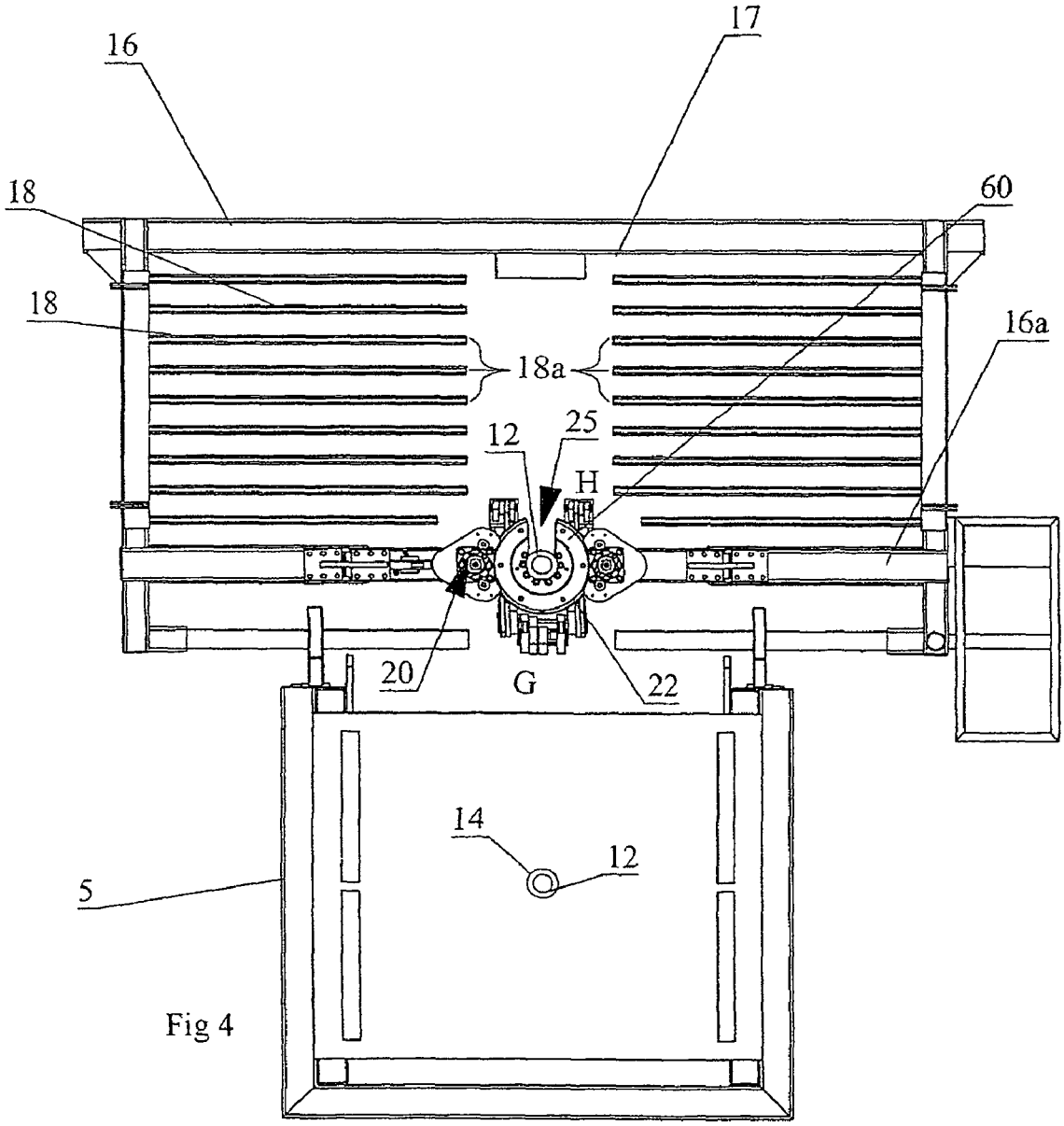
FIG. 4 is a plan view of the apparatus for handling pipes as shown in FIG. 1.
Figure 5:
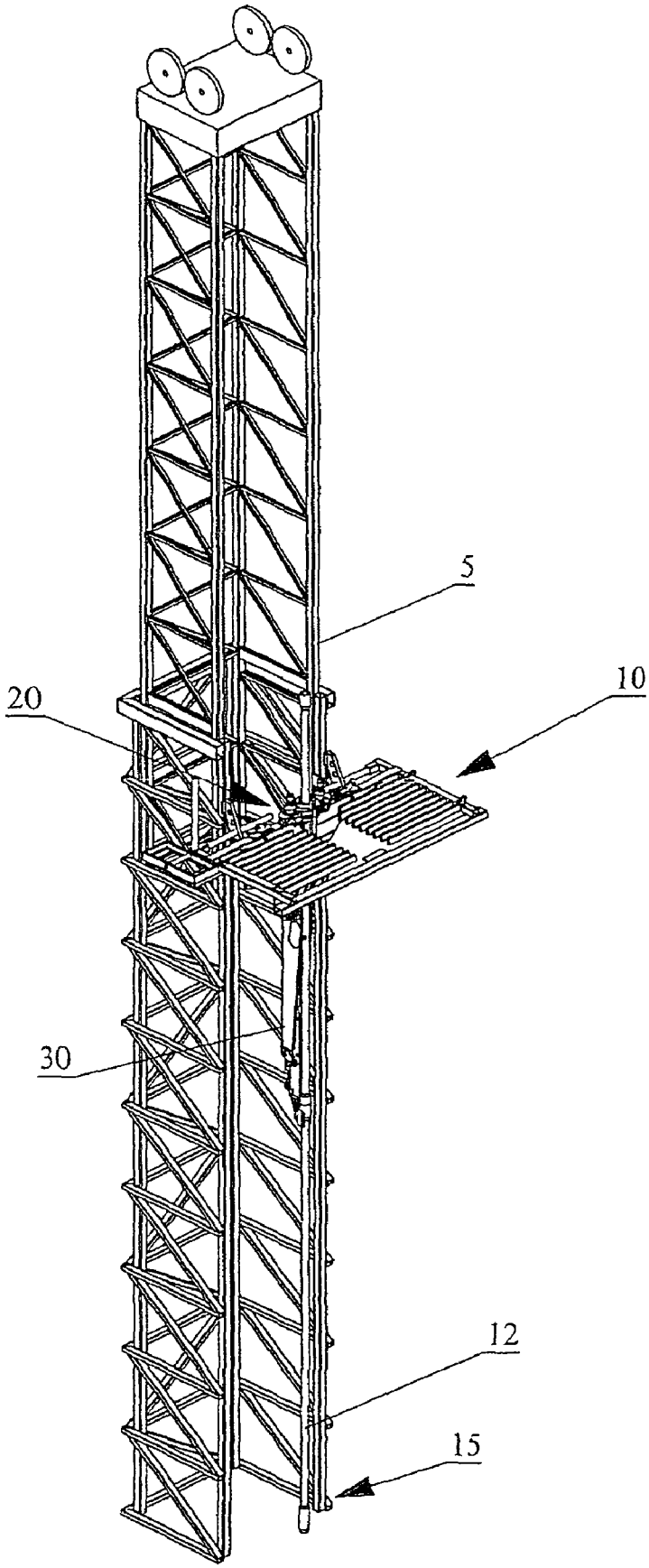
FIG. 5 is a top perspective view of the apparatus for handling pipes mounted on a derrick.

In the illustrated embodiment, not intended to be limiting, rotating gate collar 22 includes a partial bull gear 60 having a pipe receiving opening 60*a* corresponding to opening 25 of collar 22. A pipe stand 12 is slotted into opening 60*a* in direction F until centered in bull gear 60. The pipe stand is passed from outside the bull gear to its center both from the derrick (or well center) side G when the rotating gate assembly 20 is in its pipe engaging position facing derrick 5, and from the pipe racking assembly or racking board side H when the rotating gate assembly 20 is in its pipe racking position facing pipe racking assembly 10 as seen for example in FIG. 4.

Figure 6:
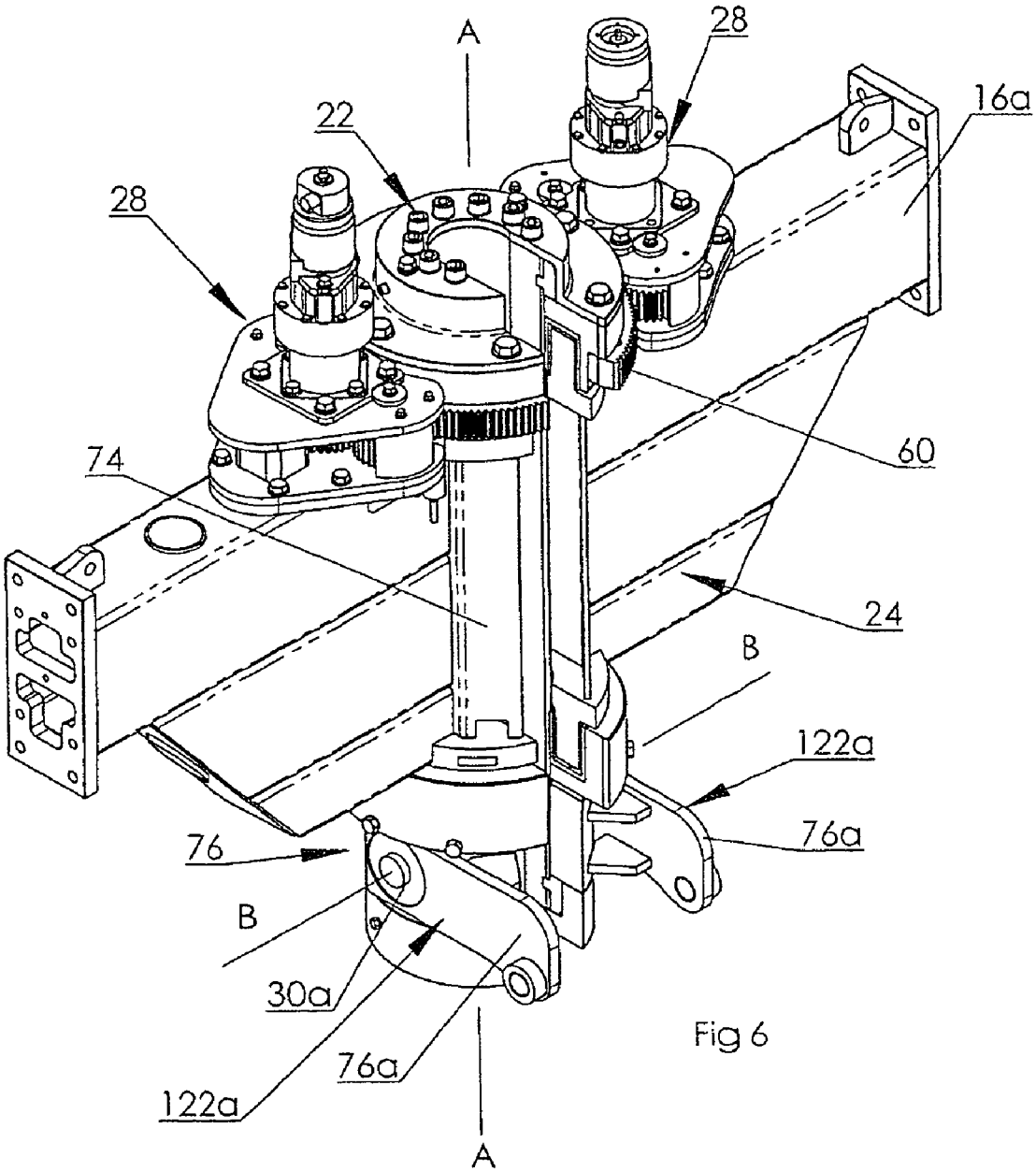
FIG. 6 is an assembled perspective view of FIG. 2*b*.
Figure 7:
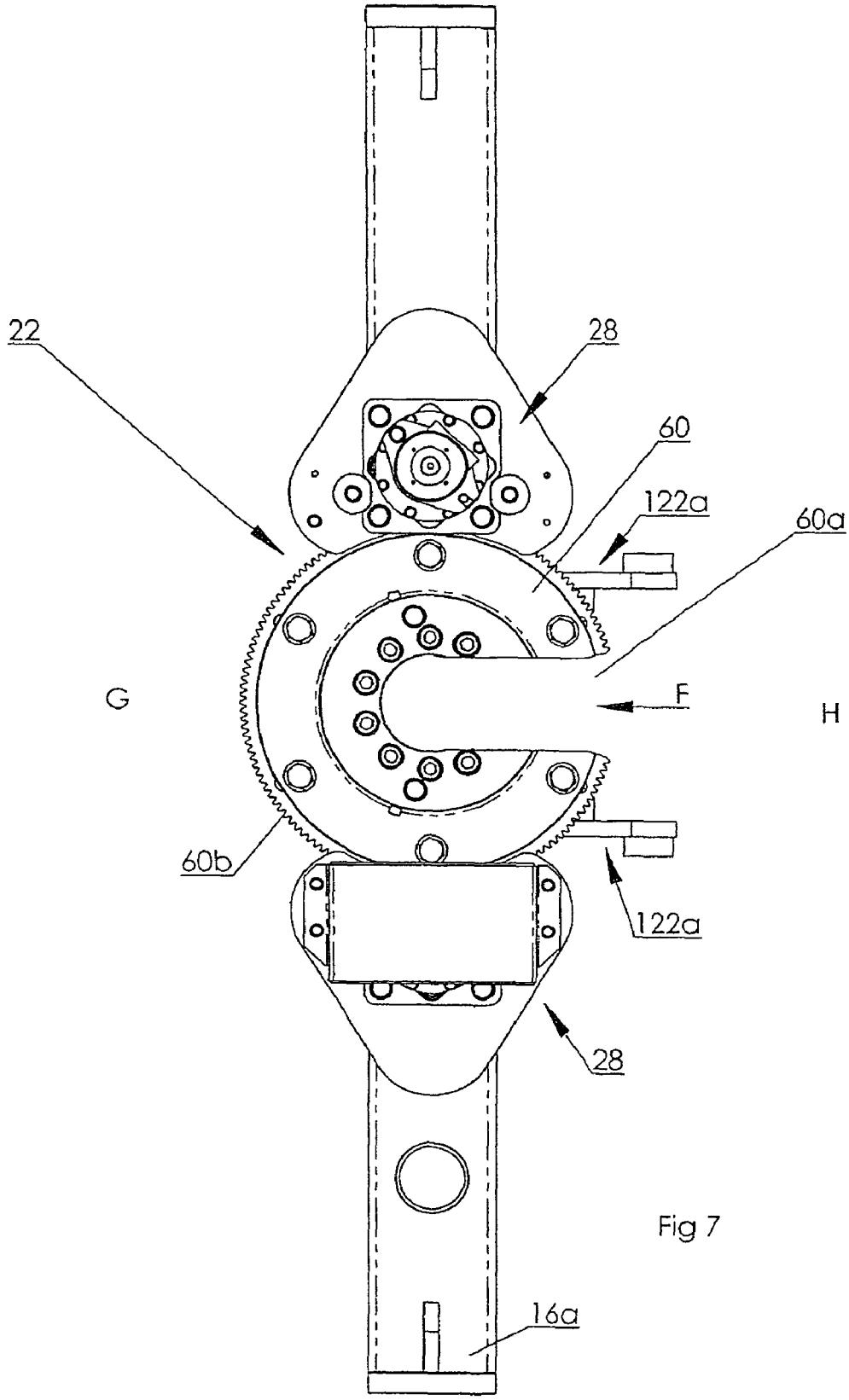
FIG. 7 is a plan view of FIG. 6.
Figure 8:
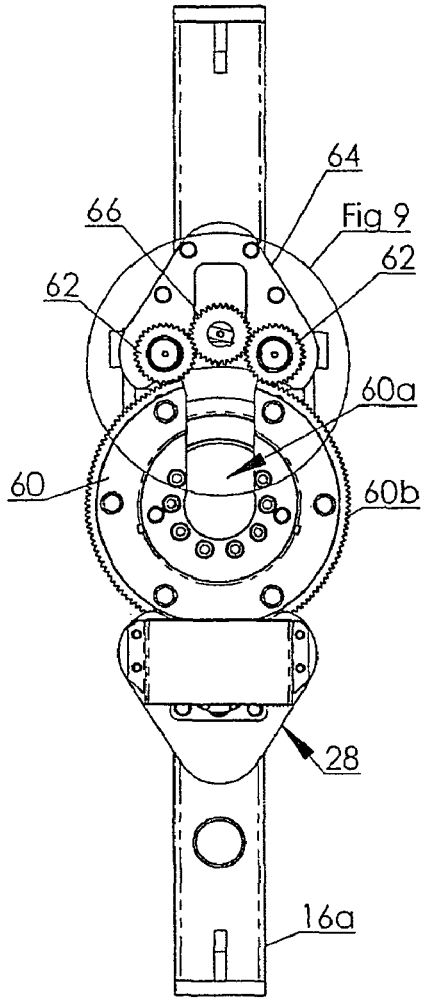
FIG. 8 is the view of FIG. 7 with the pipe retaining collar rotated ninety degrees.
Figure 9:
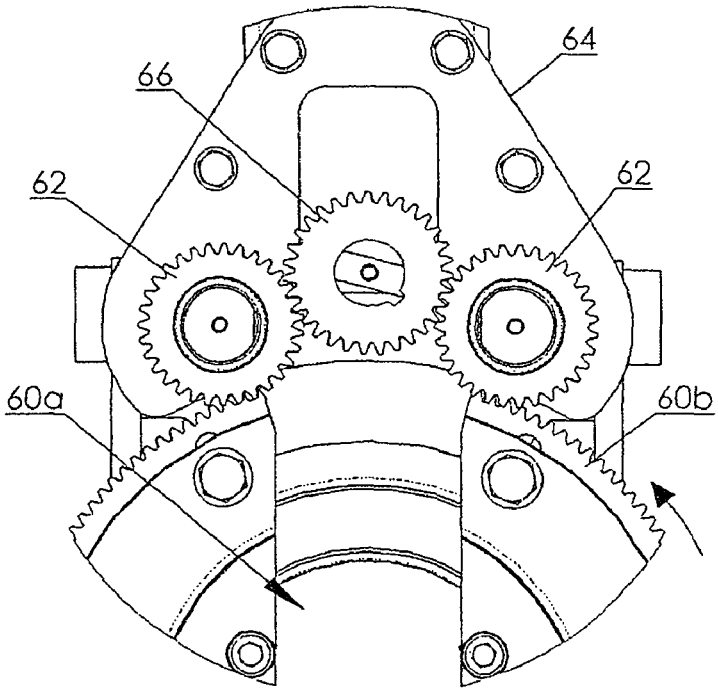
FIG. 9 is an enlarged view of a portion of FIG. 8.
Figure 10:
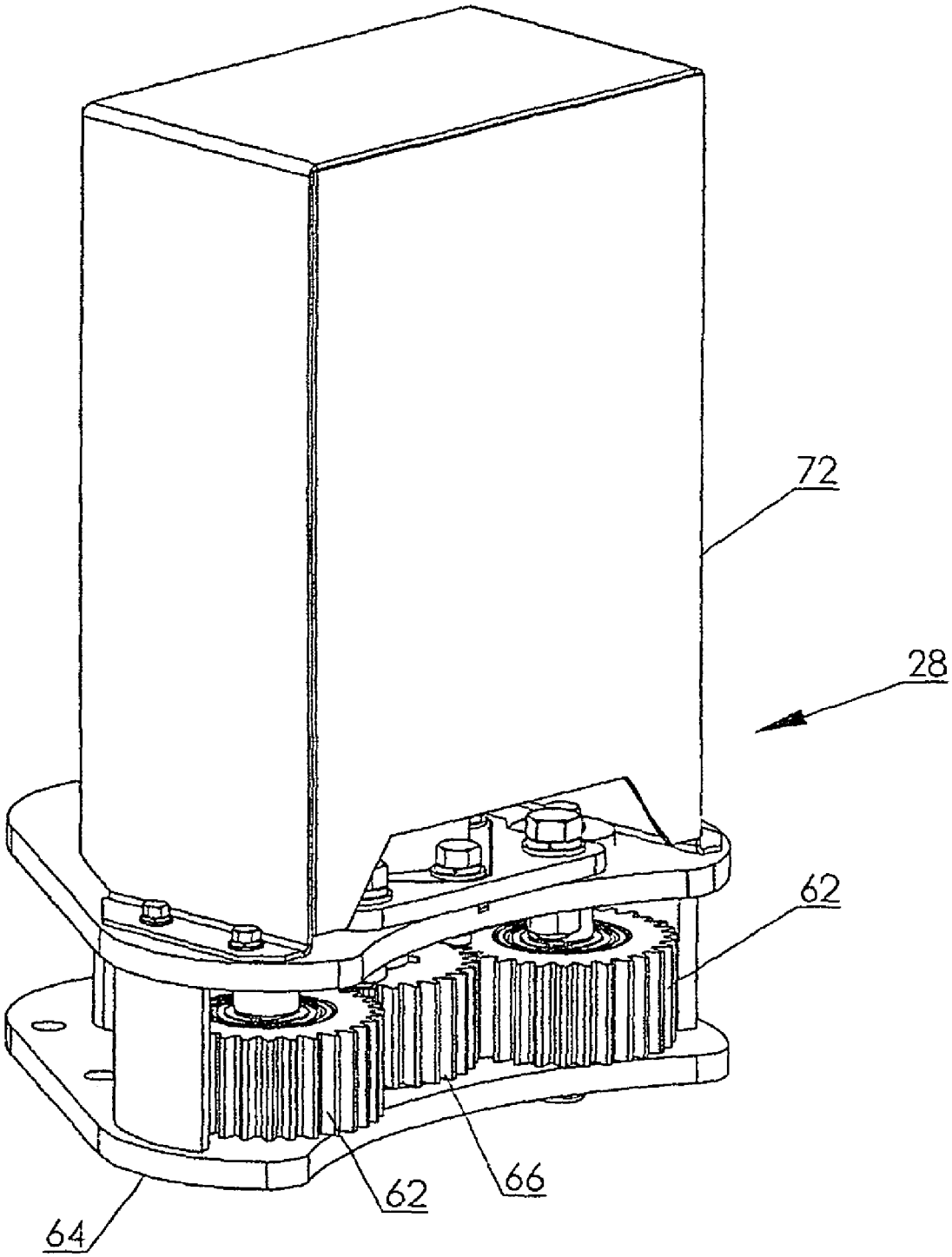
FIG. 10 is a perspective view of one drive assembly enclosed within a housing.
Figure 11:
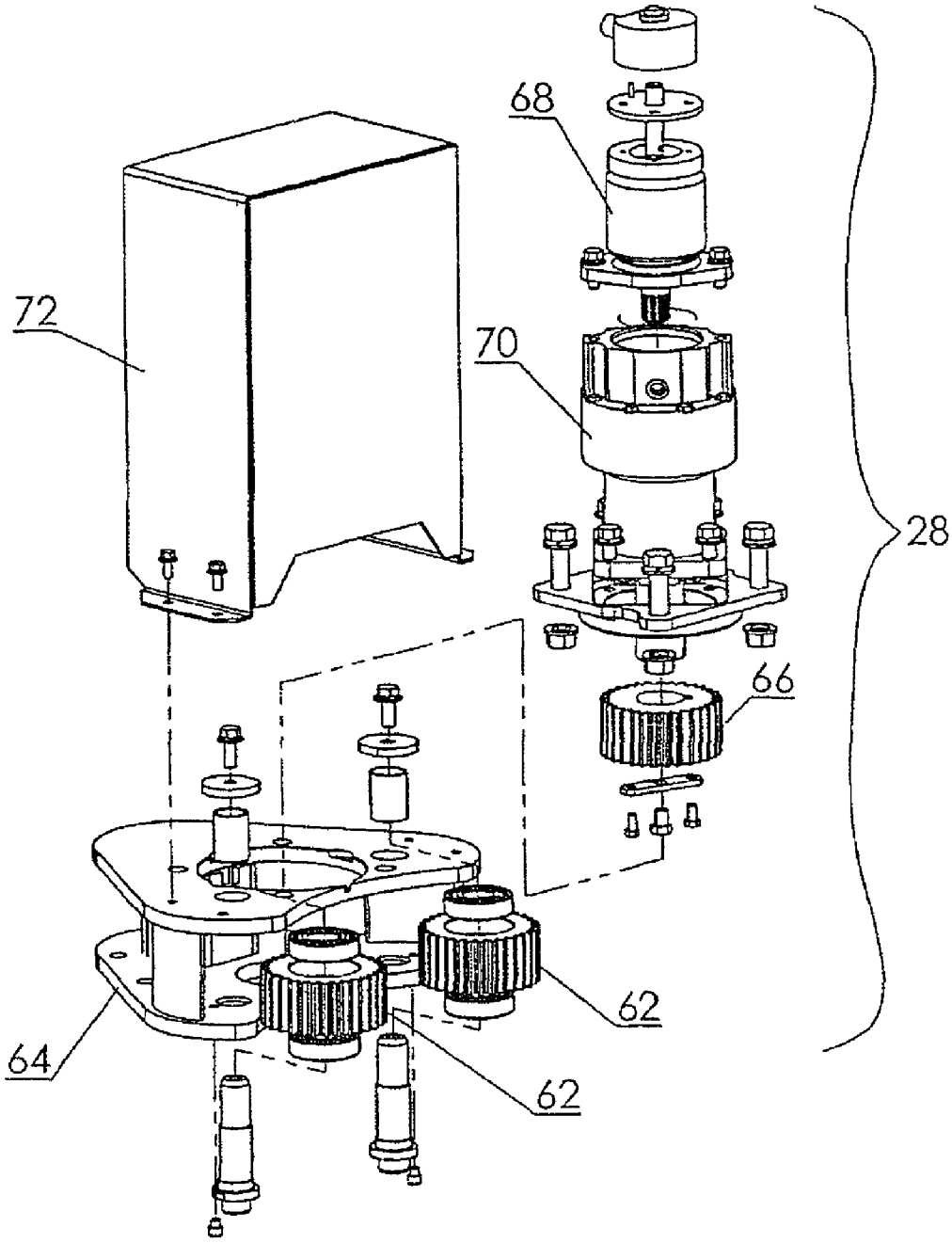
FIG. 11 is an exploded perspective view of the drive assembly and housing of FIG. 10.
Figure 12:
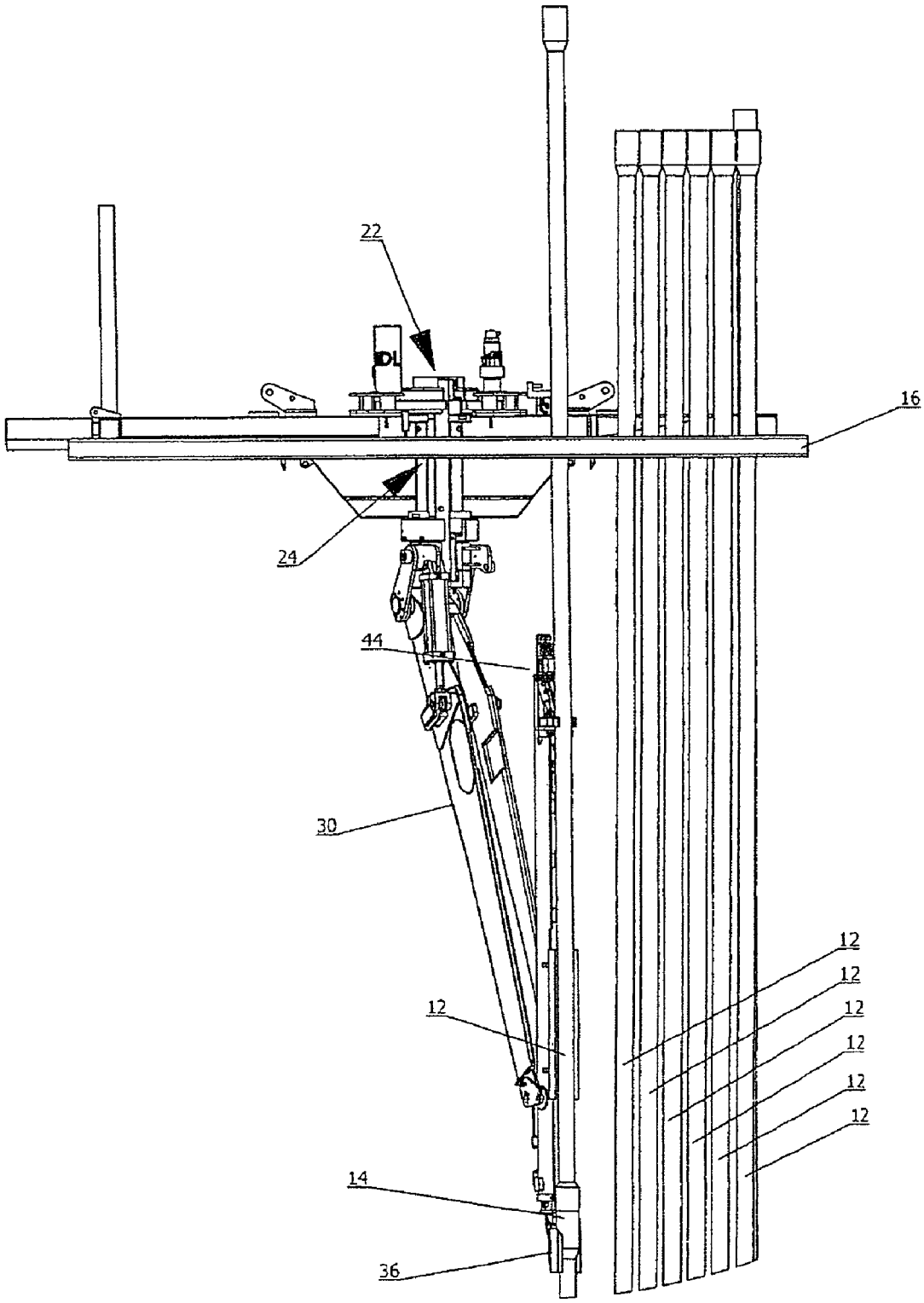
FIG. 12 is a front view of the racking assembly of FIG. 1 racking pipe stands into the rack.
Figure 13:
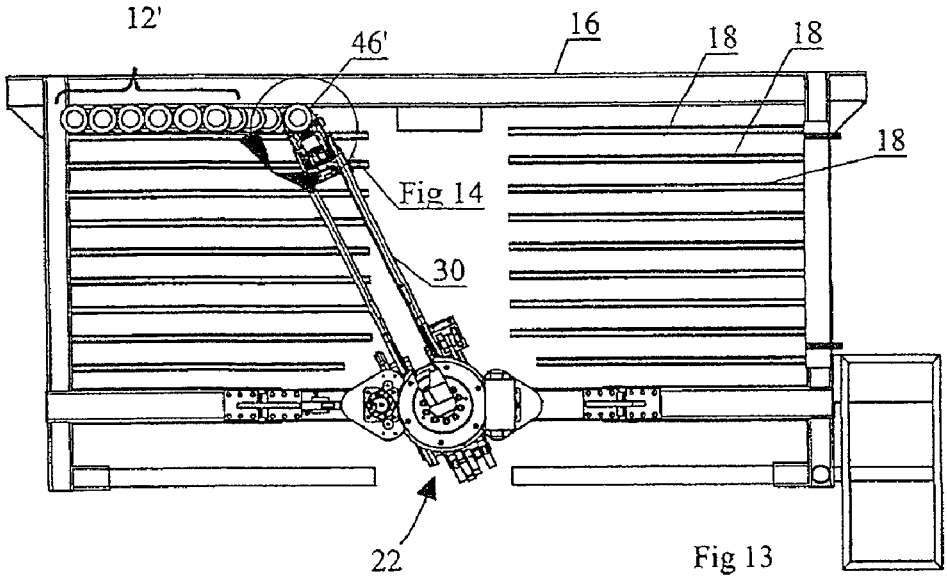
FIG. 13 is a plan view of FIG. 12.
Figure 14:
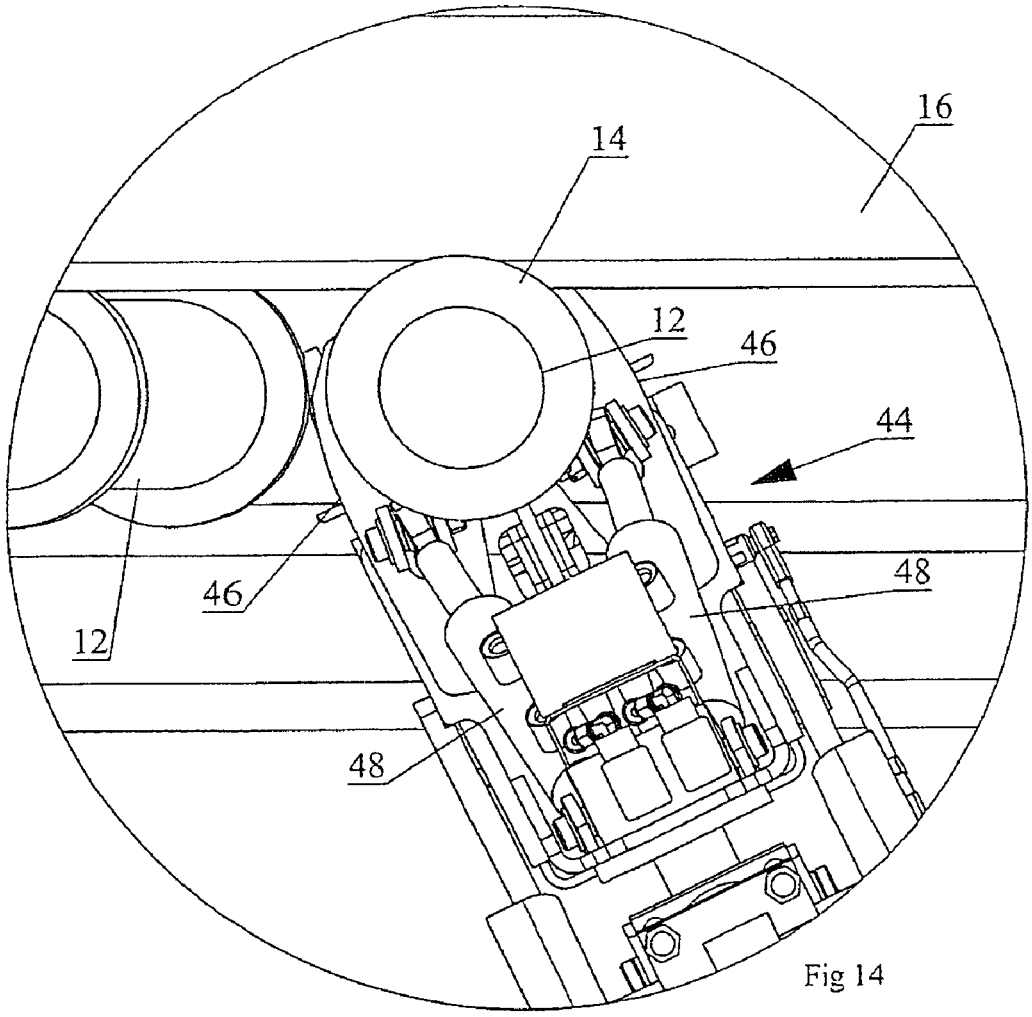
FIG. 14 is an enlarged view of a portion of FIG. 13.

Opening 60*a* is only big enough to receive a pipe stand 12. The length of the toothed circumference 60*b* of bull gear 60 is thereby kept to a maximum to maximize contact of toothed circumference 60*b* with a pair of idler gears 62 mounted on drive base support 64. Idler gears 62 are spaced apart a distance sufficient to span the opening dimension of opening 60*a* for continuous contact of at least one of the idler gears with the bull gear at all times. A drive pinion gear 66 is mounted on base support 64 between, and in contact with the pair of idler gears 62. Drive pinion gear 66 drives bull gear 60 via idler gears 62. A hydraulic motor 68 selectively drives pinion gear 66 via a planetary gear drive 70. The overall drive assembly 28, which may be housed within a cover 72, and may also be provided as a pair of such drives mounted to cross frame member 16*a* on opposite sides of bull gear 60 as seen in FIGS. 6-8. Either one or such a pair of such drives 28 may be employed to selectively rotate bull gear 60 to thereby simultaneously rotate collar assembly 22 and rotation assembly 24 including rotation tube 74, horseshoe-shaped mounting bracket 76 and its corresponding arms 76*a*. That is, the option exists to utilize one or two drive assemblies based on application torque requirements. With the design arrangement shown the ability to use one only drive motor exists as the opening of the bull gear can be bridged and the drive pinion will not come out of engagement with the bull gear. When two drive motors are used this arrangement ensures synchronization of the driving motors as again the pinions will never come out of engagement when the bull gear split 60*a* is exposed during rotation.

The design of the rotating gate and its drive, once the pipe is held within the rotating gate assembly allows the pipe to continue to move along the pipe path under the manipulated control of the carriage and arm. This is efficient because the device is mounted within the pipe path and not restricted merely to the perimeter of pipe movement.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A method for handling a pipe stand in a derrick and racking the pipe stand on a pipe rack mounted on the derrick mast wherein the mast has an open face on at least one side, the open face defined by legs of the mast, the method comprising the steps of:

a) providing:

(i) a pipe racking assembly having a rotating pipe support and an arm depending therefrom and mounting said pipe racking assembly to the legs of the open face of the mast, (ii) a selectively actuable drive coupled to said rotating pipe support for selectively driving rotation of said rotating pipe support between a mast facing position facing the open face of the mast and a pipe rack facing position facing an opening gap into the racking board, (iii) said arm having a first end and an opposite second end, said first end of said arm pivotably mounted to said rotating pipe support and actuable by an actuator cooperating with said arm so as to actuate said arm between extended and returned positions relative to said pipe racking assembly, and (iv) a releasable pipe mount mounted to said second end of said arm, said releasable pipe mount for releasably engaging the pipe stand;

b) extending said arm selectively radially outwardly of said rotating pipe support to said extended position so as to engage said pipe mount with the pipe stand and, once so engaged, c) lifting with said pipe mount the entire weight of the pipe stand so as to bear the entire weight of the pipe stand only on said pipe mount, said arm, said rotating pipe support, and said pipe racking assembly and thereby transferring the entire weight of the pipe stand to the legs of the open face of the mast;

d) pivoting said arm relative to said rotating pipe support so as to return said arm to said returned position and thereby to carry the entire weight of the pipe stand to said rotating pipe support;

e) rotating said rotating pipe support, said arm, said pipe mount and the pipe stand from said mast facing position to said pipe rack facing position;

f) extending and positioning said arm and said pipe mount while carrying the entire weight of the pipe stand, and while said arm is in said pipe rack facing position, so as to rack the pipe stand;

g) once the pipe stand is racked, releasing the pipe stand from the pipe mount and returning said arm to said rotating pipe support, rotating said rotating pipe support and said arm to said mast facing position and extending said arm and said pipe mount to retrieve a second pipe stand through the open face of the mast;

wherein said pipe racking assembly includes, mounted thereto, a rotatable gate assembly said rotatable gate assembly having a substantially U-shaped collar mounted on said rotating pipe support and said arm depending therefrom, wherein said collar defines a gate opening and corresponding pocket to receive and mate a pipe stand therein, wherein said selectively actuable drive is coupled to said collar and said rotating pipe support for selectively driven rotation thereof between said derrick facing position wherein said gate opening is facing the open face of the mast and in operable communication therewith, and a pipe rack facing position wherein said gate opening is facing the opening into the racking board and in operable communication therewith, wherein said arm selectively pivots outwardly of said rotating pipe support so as to engage said pipe mount with the pipe stand and, once so engaged, pivots so as to return said arm and so as to said receive and mate the pipe stand in said gate opening and said pocket respectively, whereupon said collar, said rotating pipe support, said arm and the pipe stand are rotated between said mast facing position and pipe rack facing position.

2. The method of claim 1 further comprising providing a pipe rack which includes a substantially planar frame containing a racking board, said frame adapted to be substantially horizontally disposed when mounted on said mast and is adapted to be only mounted to the mast such that said frame extends outwardly and away from the mast and so that the gap in the racking board providing access to fingers of the racking board is aligned with the open face of the mast, and wherein said pipe racking assembly is mounted to said frame, and to the mid-portion of the mast by mounting to the legs on the open face of the mast, so as to be positioned between the racking board and the open face of the mast.

3. The method of claim 1 wherein said releasable pipe mount is elongate so as to be substantially as long as at least one quarter of the length of the pipe stand so as to stabilize the pipe stand when carried by said pipe mount, and includes an upper securing means for engaging an upper portion of the pipe stand; and a lower securing means for engaging a lower portion of the pipe stand.

4. The method of claim 3 wherein said upper securing means is a pair of independently selectively actuable jaws, and wherein said lower securing means is a support member adapted to receive the pipe stand and to support the weight of the pipe stand and to inhibit movement of said lower portion of the pipe stand relative to said pipe mount.

5. The method of claim 4 wherein said support member is configured to engage and releasably mate with a tool joint on said pipe stand.

6. The method of claim 5 further comprising a first actuator on said pipe mount to tilt said pipe mount during pivoting of said arm so as to keep the pipe stand vertical.

7. The method of claim 6 further comprising a second actuator on said pipe mount for selectively elevating and lowering said lower securing means and simultaneously said pipe stand held within said lower securing means so as to engage or release the tool joint on the pipe stand.

8. The method of claim 6 further comprising a third actuator for displacement of said arm between a vertical position substantially parallel to the pipe stand and substantially below said collar and said rotating pipe support and an angled position of said arm wherein said pipe mount is extended away from said rotating pipe support.

9. The method of claim 8 wherein when said rotating pipe support is in said pipe rack facing position, said arm displaces from said vertical position to said angled position such that said arm transfers the pipe stand to the pipe rack.

10. The method of claim 1 wherein said collar and said rotating pipe support include a horizontal ring gear having said gate opening formed therein and defined by a sector removed from said ring gear.

11. An apparatus for handling pipe stands in a derrick and racking the pipes on a pipe rack mounted on the derrick mast wherein the mast has an open face on at least one side, the open face defined by legs of the mast, the apparatus comprising:

a pipe racking assembly having a rotating pipe support and an arm depending therefrom, a selectively actuable drive coupled to said rotating pipe support for selectively driven rotation thereof between a mast facing position facing the open face of the mast and a pipe rack facing position, facing an opening gap into the racking board, said arm having a first end and an opposite second end, said first end of said arm pivotably mounted to said rotating pipe support; and a releasable pipe mount mounted to said second end of said arm, said releasable pipe mount for releasably engaging the pipe stand;

wherein said arm selectively pivots outwardly of said rotating pipe support so as to engage said pipe mount with the pipe stand and, once so engaged, pivots so as to return said arm as said rotating pipe support, said arm and the pipe stand are rotated between said mast facing position and said pipe rack facing position, wherein said pipe racking assembly includes a substantially planar frame containing the racking board, said frame adapted to be substantially horizontally disposed when mounted on said mast and is adapted to be only mounted to the mast such that said frame extends cantilevered outwardly and away from the mast and so that the gap in the racking board providing access to fingers of the racking board is aligned with the open face of the mast, and wherein brackets are provided, mounted to said frame, said brackets adapted to be only mounted to the mid-portion of the mast by mounting to the legs of the mast on the sides of the open face of the mast, wherein the entire weight of said racking assembly including said rotating pipe support, said drive, said arm, said pipe mount, and the entire weight of the full length of a pipe stand held in said pipe mount is transferred into, so as to be solely supported by, the legs of the mast on either side of the open face located solely at a position which is substantially a pipe stand length above the rig floor, wherein said pipe racking assembly includes, mounted thereto, a rotatable gate assembly said rotatable gate assembly having a substantially U-shaped collar mounted on said rotating pipe support and said arm depending therefrom, wherein said collar defines a gate opening and corresponding pocket to receive and mate a pipe stand therein, wherein said selectively actuable drive is coupled to said collar and said rotating pipe support for selectively driven rotation thereof between said derrick facing position wherein said gate opening is facing the open face of the mast and in operable communication therewith, and a pipe rack facing position wherein said gate opening is facing the opening into the racking board and in operable communication therewith, wherein said arm selectively pivots outwardly of said rotating pipe support so as to engage said pipe mount with the pipe stand and, once so engaged, pivots so as to return said arm and so as to said receive and mate the pipe stand in said gate opening and said pocket respectively, whereupon said collar, said rotating pipe support, said arm and the pipe stand are rotated between said mast facing position and pipe rack facing position, wherein said collar and said rotating pipe support include a horizontal ring gear having said gate opening formed therein and defined by a sector removed from said ring gear, wherein said drive includes a motor and is mounted to said pipe racking assembly in cooperation with said rotating pipe support, said drive comprising a spaced apart pair of gears operably coupled to said motor and to said ring gear for selectively rotating said rotatable gate assembly.

12. The apparatus of claim 11 wherein said pair of gears are spaced apart a horizontal distance which is not substantially less than a width of said gate opening whereby at least one of said pair of gears is in operable contact with said ring gear at all times during rotation of said rotatable gate assembly.

* * * * *